US007575335B2

(12) United States Patent
Neal et al.

(10) Patent No.: US 7,575,335 B2
(45) Date of Patent: Aug. 18, 2009

(54) SWITCHING ILLUMINATING NAIL CLIPPERS

(75) Inventors: Margaret S. Neal, San Rafael, CA (US); Phillip H. Neal, San Rafael, CA (US); Michael J. Liebowitz, Concord, CA (US)

(73) Assignee: Go Products, Inc., Greenbrae, CA (US)

( * ) Notice: Subject to any disclaimer, the term of this patent is extended or adjusted under 35 U.S.C. 154(b) by 0 days.

(21) Appl. No.: 11/308,857

(22) Filed: May 16, 2006

(65) Prior Publication Data

US 2007/0017537 A1 Jan. 25, 2007

Related U.S. Application Data

(60) Provisional application No. 60/594,937, filed on May 20, 2005.

(51) Int. Cl.
*B25B 23/18* (2006.01)

(52) U.S. Cl. ..... 362/119; 132/73.2

(58) Field of Classification Search ..... 362/119, 362/109, 800; 132/73.5, 75.5; 30/26–29, 30/123

See application file for complete search history.

(56) References Cited

U.S. PATENT DOCUMENTS 6,220,251 B1 * 4/2001 Jeong et al. ..... 132/73.5
6,553,592 B2 * 4/2003 Yang et al. ..... 7/162
7,131,448 B2 * 11/2006 Lund et al. ..... 132/73.5
7,263,775 B2 * 9/2007 Moulton, III ..... 30/29
2004/0123875 A1 * 7/2004 Kim ..... 132/73.5

* cited by examiner

*Primary Examiner*—Hargobind S Sawhney
(74) *Attorney, Agent, or Firm*—Michael E. Woods

(57) ABSTRACT

An apparatus and method for improving local illumination of a nail-cutting implement, such as clippers for human or animal nails. The apparatus includes a first plate terminating at one end in a first angled cutting edge; a second plate, coupled to and biased away from the first plate, terminating at one end in a second angled cutting edge springingly engaging with the first angled cutting edge; a shaft coupled to the plates proximate the cutting edges, for retaining a lever, the lever operating the plates in cooperation with the shaft to springingly engage and disengage the cutting edges relative to each other; an illumination system directing illumination into a field-of-view in an "ON" mode and the illumination system including an "OFF" mode in which the illumination system is inactive; and an illumination boom, coupled to one of the plates, for positioning the illumination system between a stowed position and an operating position, the stowed position engaging the OFF mode and the operating position engaging the ON mode to include the cutting edges within the field-of-view.

18 Claims, 2 Drawing Sheets

SWITCHING ILLUMINATING NAIL CLIPPERS

CROSS REFERENCE TO RELATED APPLICATIONS

The present application is related to and claims benefit of U.S. Application No. 60/594,937 entitled "Switching Illuminating Nail Clippers" filed 20 May 2005, and is related to U.S. application Ser. No. 11/308,858 entitled "Switching Illuminating Tweezers with Magnifier," filed concurrently that claims benefit of related U.S. Application No. 60/594,940 entitled "Switching Illuminating Tweezers with Magnifier," filed 20 May 2005, and is related to U.S. application Ser. No. 11/308,859 entitled "Switching Illuminating Scissors," filed concurrently that claims benefit of related U.S. Application No. 60/594,938 entitled "Switching Illuminating Scissors," and filed 20 May 2005, and is related to U.S. application Ser. No. 11/308,860 entitled "Packaging Arrangement Having Package Feature For Biasing A Switch From An On Mode To An Off Mode," filed concurrently that claims benefit of related U.S. Application No. 60/594,939 entitled "Packaging Arrangement Having Package Feature For Biasing A Switch From An On Mode To An Off Mode," filed 20 May 2005 with each related application incorporated by reference in their entireties for all purposes.

BACKGROUND OF THE INVENTION

The present invention relates generally to personal care products, and more specifically to illuminated implements for use by a caregiver when providing personal care to its charge.

Personal care products and tools have evolved and been developed for attending to personal hygiene of a human body. The evolution and development of these products and tools has largely been to enhance products for use by an individual in performance of their own personal care. When only a single person is involved, and that person controls the timing, urgency, and manner of performance of the product or tool, different parameters of the product or tool are optimized, created, emphasized and/or implemented.

However, when providing personal care for another person, particularly to a very young child or senior adult, the caregiver does not always control the timing, urgency, and manner of performance. Specifically, the caregiver may desire to provide various personal care procedures at times or locations that are not otherwise optimal. One common environmental factor that may not be able to be optimized in such situations is a level of ambient light in the vicinity of the procedure.

Besides these concerns, when providing personal care for another person, particularly to a very young child or senior adult, many caregivers prefer to enhance the level of care provided, including greater attention to safety procedures and use of safer tools. This is true even in situations where the caregiver may control some of the timing, urgency, and manner of performance, such as to increase a general level of ambient light. For this example, the caregiver may desire to precisely increase a level of illumination for use of personal care tool when a very young child or senior adult is involved.

Beyond these concerns, factors for acceptability and adoption of personal care procedures include ease of use, convenience, efficiency, and effectiveness. Portable illumination components (e.g., flashlights) have existed separate and distinct from tools so conventional systems either require coordination of the light source and a tool, or various forms of integration have been developed to mate a light to a tool.

Some of the integration are simple physical connections that keep the tool and the light source together while others actually try to achieve a more synergistic combination. Maintaining ease of use, convenience, efficiency, and effectiveness becomes more challenging as multiple diverse functions are merged together. In the example of personal care applied to a young child or senior adult, enabling single-handed use and operation while providing the multiple diverse functions becomes increasingly difficult yet even more challenging. A caregiver often must use one hand for the tool and the other to interact with the young child or senior adult.

It should not be missed that improvements to procedures and tools that aid a care giver when attending to young children and senior adults may in many cases also assist in self-administration and self-care. Thus, it is a consideration that improvements to procedures and tools for administration to others not degrade or adversely affect self-administration.

One consequence of these factors is that some personal care products and tools are sometimes equipped with lights. Such conventional personal care products and tools have ON-OFF switches to control the light source independent from operation. The light for these devices is thus not always active and useful when the user operates the device. In some cases, operation of the device is delayed or interrupted while the light is manually illuminated. In other cases, the light is left on beyond the time of use because the switch was not manually returned to the off position, decreasing the longtime usefulness of the product or tool. Caregivers would prefer to have a product or tool that does not delay or interrupt their use, and one that does not have a premature end to its anticipated usefulness.

Today's consumer is inundated with offers to sell many different products and services, some of which may actually be of interest to the potential consumer. In some instances, interactive packaging (also sometimes referred to as "Try Me" packaging) may enhance an appeal of a product. For such products, it is advantageous to provide appropriate "Try Me" packaging. However, the state of the art does not permit a priori knowledge as to which products would be benefited from being packaged in an interactive format. Developing a superior product does not always equate with increased sales, at least until the market knows and understands the new product. There are many consumer products that incorporate microprocessors and microcontrollers that may include "Try Me" routines or programs that effectively address some of the concerns of "Try Me" packaging. However, for articles of manufacture that do not include electronic controllers, designing a product and its packaging to implement "Try Me" retailing is more challenging. Some conventional products have developed use of momentary switches or special multi-function switches so that a "continuous on" mode of the switch may be disabled by the packaging while providing access to an "On while pressed" mode of the switch.

What is needed are personal care products, tools, and procedures that address and overcome the deficiencies of the current products and tools; specifically what is needed are products, tools, and procedures for simply and efficiently increasing a level of illumination at the operational point of personal care products, tools, and procedures. Additionally, designing such products, tools, and procedures so that they include features or functions that may be emphasized in suitable interactive packaging is also beneficial.

BRIEF SUMMARY OF THE INVENTION

Disclosed is an apparatus and method for improving local illumination by a nail-cutting implement, such as clippers for human or animal nails. The apparatus includes a first plate terminating at one end in a first angled cutting edge; a second plate, coupled to and biased away from the first plate, terminating at one end in a second angled cutting edge springingly engaging with the first angled cutting edge; a shaft coupled to the plates proximate the cutting edges, for retaining a lever, the lever operating the plates in cooperation with the shaft to springingly engage and disengage the cutting edges relative to each other; an illumination system directing illumination into a field-of-view in an "ON" mode and the illumination system including an "OFF" mode in which the illumination system is inactive; and an illumination boom, coupled to one of the plates, for positioning the illumination system between a stowed position and an operating position, the stowed position engaging the OFF mode and the operating position engaging the ON mode to include the cutting edges within the field-of-view.

Preferred embodiments of the present invention include personal care products, tools, and procedures that address and overcome the deficiencies of the current products and tools; specifically products, tools, and procedures that simply and efficiently increase a level of illumination at the operational point of personal care products, tools, and procedures. Additionally, the preferred embodiments include features or functions that may be emphasized in suitable interactive packaging.

DETAILED DESCRIPTION OF THE INVENTION

The present invention provides an apparatus and method for an illuminating nail cutting implement as well as implementation of a design paradigm for enabling "Try Me" retail packaging with a function controlled by physical manipulation of a handle or lever included as part of the product. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
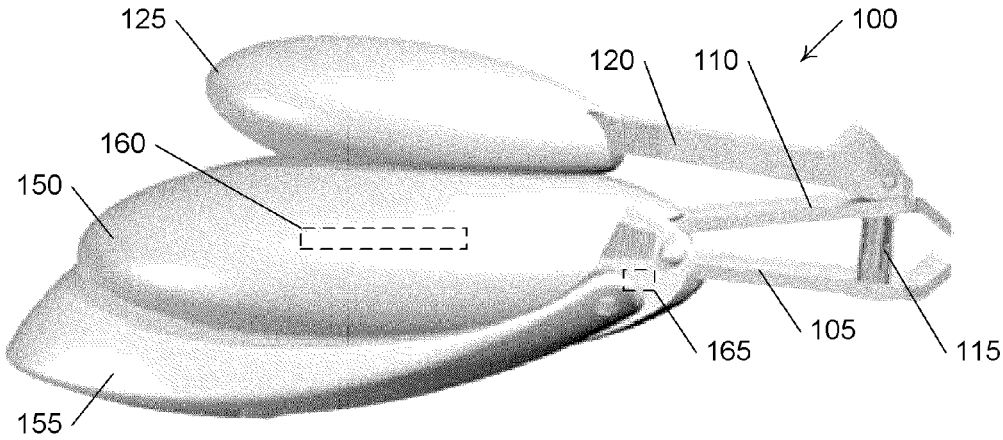
FIG. 1 is a lateral view of a preferred embodiment of the present invention for an illuminated clipper in a closed configuration.

FIG. 1 is a lateral view of a preferred embodiment of the present invention for an illuminated clipper 100 in a closed configuration. Clipper 100 includes a first plate 105, a second plate 110, a shaft 115, and a lever 120. The plates include cooperating cutting edges, with plate 105, plate 110, shaft 115 and lever 120 conventionally interconnected to produce a nail-cutting implement. This implement, as shown, is configured for human fingernails but as well-known, other configurations for the plates, shaft, and lever may be adapted to cut other nails, for example toenails and nails of non-humans.

Clipper 100 includes, in addition to the components of the nail-cutting implement, a molded thumb pad 125 and an illumination subsystem that includes a housing 150, and an illumination boom 155 moveably coupled (e.g., rotationally) to housing 150. Housing 150 contains a battery 160 and a switch 165 for controlling an illumination source (such as a white LED shown in FIG. 3) and encloses a back end of plate 105 and plate 110. In the closed configuration shown in FIG. 1, clipper 100 has illumination boom 155 and lever 120 folded against housing 150.

Figure 2:
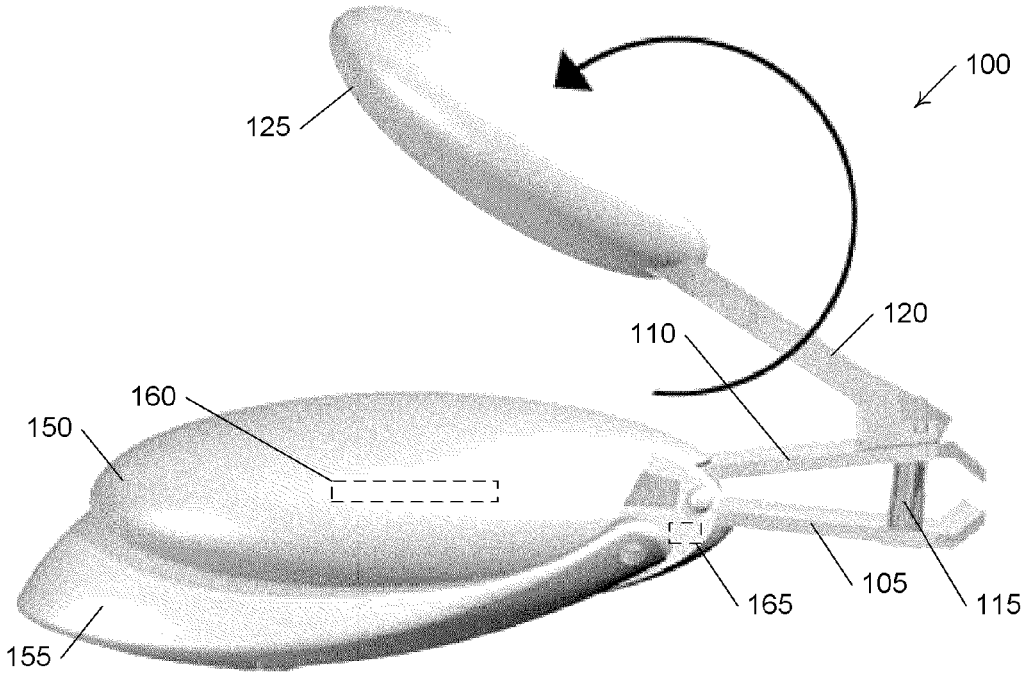
FIG. 2 is the lateral view of the illuminated clipper of FIG. 1 in an open mode with a lever shown lifted and rotated into an operating position.

FIG. 2 is the lateral view of the illuminated clipper of FIG. 1 in an open mode with lever 120 lifted and rotated into an operational position. The preferred embodiment shown for clipper 100 permits operation without activating the illumination subsystem and deploying illumination boom 155 when illumination is not necessary or desired. In the open mode, clipper 100 operates in conventional fashion in which lever 120 cooperates with shaft 115 to springingly engage and disengage cooperating cutting edges disposed on ends of plate 105 and plate 110. Thumb pad 125 and housing 150/boom 155 provide for grips so that the cutting edges are easily manipulated by squeezing and relaxing lever 120 relative to housing 150. In the preferred embodiments, the grips are adapted to enhance the clipping experience, which may include widening, lengthening, conforming, and other modifications to the grip dimensions, as well as material selection (e.g., cushioning) to enhance operation of the clipping subsystem.

Figure 3:
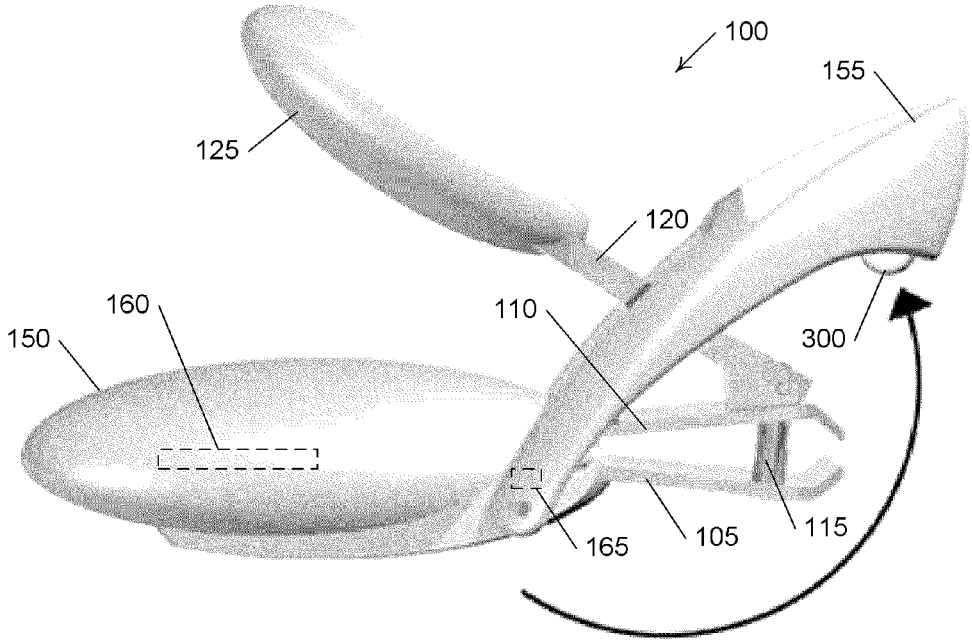
FIG. 3 is the lateral view of the illuminated clipper of FIG. 2 in the open mode with the illumination boom in an operational mode.

FIG. 3 is the lateral view of illuminated clipper 100 of FIG. 2 in the open mode with illumination boom 155 in an operational mode. Engaging an operational mode of illumination boom 155 exposes an illumination source 300 and positions source 300 at a position between a user and the cutting edges to illuminate a field-of-view that includes the cutting edges and some appropriate distance in front. In the preferred embodiment, source 300 is powered by battery 160 and an ON/OFF status of source 300 is controlled by switch 165. Switch 165 is coupled to illumination boom 155 so movement of boom 155 between the operational mode and the stowed mode controls switch operation.

As shown in this preferred embodiment, boom 155 rotates greater than one hundred eighty degrees relative to housing 150 when moving between the stowed and the operation modes and switch 165 is coupled to a pivot point so the rotation controls operation of switch 165. In the most preferred embodiment, as explained below, the configuration of switch 165 in relation to ON/OFF switching responsive to rotation is established so that source 300 is off except for the last few degrees (e.g., about five degrees) of a range of rotation, though implementations and embodiments may vary.

A threshold for determining the ON/OFF responsiveness of switch 165 varies in different embodiments and implementations, however the preferred embodiment more easily permits use of a package-enhancing features during marketing, such as a "Try Me" package. Thus the features of incorporating switch 165 into clippers 100 in a manner that source 300 is responsive to operational deployment and establishing thresholds for ON/OFF responsiveness so that a desired feature (in this case illumination) is enabled during a small end-portion of boom-deploying rotation, combines to produce in this implementation characteristics for clipper 100 that enable consumer-level retail "Try Me" packaging. (Such as, for example, providing packaging that lightly biases illumination boom 155 into a rotational position close to the threshold, but with source 300 inactive.) The packaging, in permitting a prospective customer to move boom 155 past the threshold to activate source 300 interactively presents the illumination feature, but returns source 300 to the inactive status when the prospective customer is done interacting with the packaging. Providing the boom close to the threshold, near the extreme end of range of movement, and using a lever arm, permits the biasing mechanism in the packaging to be implemented efficiently and inexpensively. For example, foam may be adhered to appropriate portions of a package in contact with the actuating handle. Other biasing systems, e.g., metal springs and the like, may also be used. This configuration permits light force, short distance biasing systems to be used that are often quite simple, effective, virtually error-free, and inexpensive.

Figure 4:
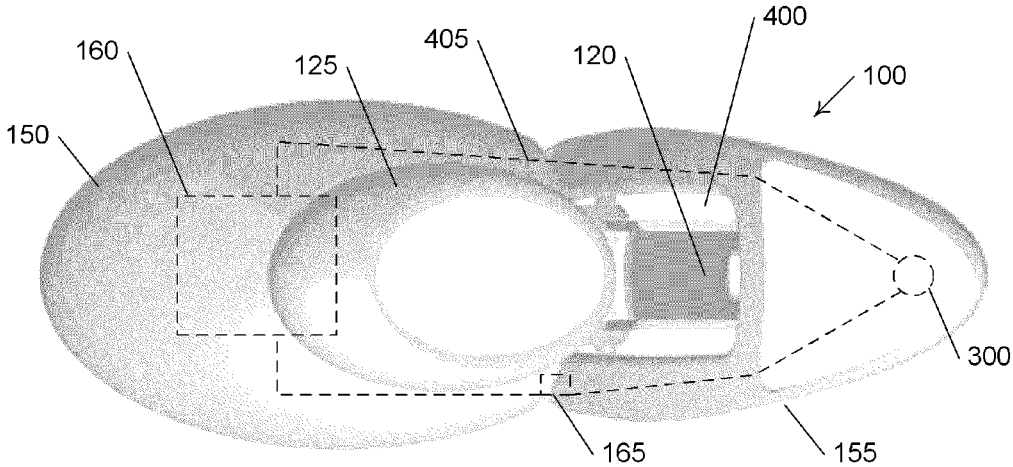
FIG. 4 is a top view of the illuminated clipper shown in FIG. 3.

FIG. 4 is a top view of illuminated clipper 100 shown in FIG. 3. As shown, clipper 100 includes an aperture 400 in boom 155 that permits the ends of the plates to pass through boom 155 as it is moved to the operational mode from the stowed mode and permits lever 120 to control cutting action while boom 155 is located generally between a user and the cooperating cutting edges. Additionally, FIG. 4 illustrates an electrically conductive path 405 that forms an electrical circuit for battery 160, switch 165 and source 300. Current in this electrical circuit is controlled by switch 165, and switch 165 is controlled in turn by a positional rotation of illumination boom 155.

In operation, a user opens clipper 100 by lifting and rotating lever 120 to permit clipping operations. In the event that the user desires or requires illumination of a clipping zone that includes the cutting edges and some appropriate distance in front of the cutting edges determined by the application, the user rotates boom 155 from the stowed position to the operational position. Switch 165, sometime during this rotation of boom 155 as determined by design considerations specific to an embodiment and implementation, closes conductive path 405 to cause battery 160 to produce an electrical potential across source 300 so that source 300 illuminates the clipping zone. When clipping is complete, or illumination is no longer needed or desired in the clipping zone, the user rotates boom 155 from the operational mode to the stowed mode, opening path 405 and extinguishing source 300. When boom 155 is in the stowed mode, boom 155 and housing 150 protect source 300 and help to keep it clean.

Other variations and modifications are possible without departing from the spirit and scope of the present invention, some of these variations and modifications are described above, Other variations and modifications include changes to battery location and a location/operation of boom 155. Boom 155 variations may include differences in stowage/operational locations (e.g., illuminating from a location near a rear of the housing and the like), as well as a manner of transitioning between these modes besides or in addition to rotating (e.g., sliding, shifting, expanding, traversing, and the like). Further, in the preferred embodiment, a synergistic combination of the illumination boom and the housing is achieved by providing for the stowage mode to be "beneath" the housing. The synergy is that this configuration permits the light source and "underside" of the illumination boom to be protected by the housing when illumination is not desired. Thus to position the light source for such a boom into a desired location of shining "down" on the cutting edges, the illumination boom rotates greater than one hundred eighty degrees relative to the housing when swinging out from under the housing. However, in other configurations, implementations, and embodiments, such as when boom is stowed on top of the housing, the boom rotates between about ninety and about one hundred degrees relative to the housing. In such a case, a different protection mechanism is necessary. This is relative movement as a user may alternatively hold the boom stationary and move the housing, or some combination of movement of both components.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures may also be implemented in a more separated or integrated manner, or even removed or rendered as inoperable in certain cases, as is useful in accordance with a particular application. It is also within the spirit and scope of the present invention to implement a program or code that may be stored in a machine-readable medium or transmitted using a carrier wave to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

The above-described arrangements of apparatus and methods are merely illustrative of applications of the principles of this invention and many other embodiments and modifications may be made without departing from the spirit and scope of the invention as defined in the claims.

These and other novel aspects of the present invention will be apparent to those of ordinary skill in the art upon review of the drawings and the remaining portions of the specification. Therefore, the scope of the invention is to be determined solely by the appended claims.

What is claimed as new and desired to be protected by Letters Patent of the United States is:

1. An apparatus, comprising:

a lower plate terminating at one end in an upwardly directed cutting edge;

an upper plate, coupled to and biased away from said lower plate, terminating at one end in a downwardly directed cutting edge springingly engaging with said upwardly directed cutting edge;

a shaft coupled to said plates proximate said cutting edges, for retaining a lever, said lever operating said plates in cooperation with said shaft to springingly engage and disengage said cutting edges relative to each other;

an illumination system directing illumination into a field-of-view in an "ON" mode and said illumination system including an "OFF" mode in which said illumination system is inactive; and an illumination boom, coupled to said lower plate, for positioning said illumination system on a stowed position with said lower plate disposed between said illumination boom and said upper plate, said stowed position engaging said OFF mode and said operating position engaging said ON mode to include said cutting edges within said field-of-view.

2. The apparatus of claim 1 wherein said illumination boom is pivotally coupled to said lower plate and said operating position includes rotating said boom greater than one hundred eighty degrees relative to said lower plate to include said cutting edges within said field of view from above said cutting edges.

3. The apparatus of claim 1 wherein said illumination system includes a switchable, battery-operated light emitting diode (LED).

4. The apparatus of claim 1 wherein said lever is operable with said illumination boom in said stowed position and in said operating position.

5. An apparatus, comprising:

a first plate terminating at one end in a first angled cutting edge;

a second plate, coupled to and biased away from said first plate, terminating at one end in a second angled cutting edge springingly engaging with said first angled cutting edge;

a shaft coupled to said plates proximate said cutting edges, for retaining a lever, said lever operating said plates in cooperation with said shaft to springingly engage and disengage said cutting edges relative to each other;

an illumination system directing illumination into a field-of-view in an "ON" mode and said illumination system including an "OFF" mode in which said illumination system is inactive; and an illumination boom, coupled to said first plate, for positioning said illumination system on a stowed position with said first plate disposed between said illumination boom and said second plate, said stowed position engaging said OFF mode and said operating position engaging said ON mode to include said cutting edges within said field-of-view.

6. The apparatus of claim 5 wherein said illumination boom is pivotally coupled to said first plate and said operating position includes rotating said boom greater than one hundred eighty degrees relative to said first one plate to include said cutting edges within said field of view from a position generally between said cutting edges and an eye of a user during operation of said lever for engaging and disengaging said cutting edges.

7. A method, the method comprising:

a) providing a nail clipper with an illumination subsystem integrated into a handle wherein said illumination subsystem is responsive to a switch coupled to said handle;

b) actuating said illumination subsystem by positioning said handle into an operational mode that directs illumination from said illumination subsystem into a field-of-view that includes a pair of cooperating cutting edges of said nail clipper wherein said positioning moves said handle from a stowed mode to said operational with said stowed mode including said handle located proximate a bottom plate of said nail clipper having a first one of said cooperating cutting edges with said bottom plate disposed between said handle and an upper plate of said nail clipper, said upper plate having a second one of said cooperating cutting edges.

8. The method of claim 7 wherein said handle includes an illumination boom supporting a light source.

9. The method of claim 8 wherein said illumination boom rotates into said operational mode.

10. The method of claim 9 wherein said illumination boom rotates more than one hundred eighty degrees relative to said nail clipper when rotating into said operational mode.

11. The method of claim 9 wherein said light source is activated within about five degrees of an end of a range of rotation for said illumination boom.

12. An apparatus comprising:

a lower plate terminating at one end in an upwardly directed cutting edge;

an upper plate, coupled to and biased away from said lower plate, terminating at one end in a downwardly directed cutting edge springingly engaging with said upwardly directed cutting edge;

a shaft coupled to said plates proximate said cutting edges, for retaining a lever, said lever operating said plates in cooperation with said shaft to springingly engage and disengage said cutting edges relative to each other;

an illumination system directing illumination into a field-of-view in an "ON" mode and said illumination system including an "OFF" mode in which said illumination system is inactive; and an illumination boom, coupled to said lower plate, for positioning said illumination system between a stowed position and an operating position, said stowed position engaging said OFF mode and said operating position engaging said ON mode to include said cutting edges within said field-of-view;

wherein said illumination boom is pivotally coupled to said lower plate and said operating position includes rotating said boom greater than one hundred eighty degrees relative to said lower plate to include said cutting edges within said field of view from above said cutting edges.

13. The apparatus of claim 12 wherein said illumination system includes a switch in series with a battery-operated light emitting diode (LED), and wherein said illumination boom controls said switch with said LED illuminated when said boom is in said operating position and said LED inactive when said boom is in said stowed position.

14. The apparatus of claim 12 wherein said lever is operable with said illumination boom in said stowed position and in said operating position.

15. The apparatus of claim 13 wherein said lever is operable with said illumination boom in said stowed position and in said operating position.

16. An apparatus, comprising:

a first plate terminating at one end in a first engled cutting edge:

a second plate, coupled to and biased away from said first plate, terminating at one end in a second angled cutting edge springingly engaging with said first engled cutting edge;

a shaft coupled to said plates proximate said cutting edges, for retaining a lever, said lever operating said plates in cooperation with said shaft to springingly engage and disengage said cutting edges relative to each other;

an illumination system directing illumination into a field-of-view in an "ON" mode and said illumination system including an "OFF" mode in which said illumination system is inactive; and an illumination boom, coupled to said first plate, for positioning said illumination system between a stowed position and an operating position, said stowed position engaging said OFF mode and said operating position engaging said ON mode to include said cutting edges within said field-of-view;

wherein said illumination boom is pivotally coupled to said first plate and said operating position includes rotating said boom greater than one hundred eighty degrees relative to said first plate to include said cutting edges within said field of view from a position generally between said cutting edges and an eye of a user during operation of said lever for engaging and disengaging said cutting edges.

17. A method, the method comprising:

a) providing a nail clipper with an illumination subsystem integrated into a handle wherein said illumination subsystem is responsive to a switch coupled to a handle;

b) actuating said illumination subsystem by positioning said handle into an operational mode that directs illumination from said illumination subsystem into a field-of-view that includes a cutting edge of said nail clipper; wherein said handle includes an illumination boom supporting a light source; wherein said illumination boom rotates into said operational mode; and wherein said illumination boom rotates more than one hundred eighty degrees relative to said nail clipper when rotating into said operational mode.

18. A method, the method comprising:

a) providing a nail clipper with an illumination subsystem integrated into a handle wherein said illumination subsystem is responsive to a switch coupled to a handle;

b) actuating said illumination subsystem by positioning said handle into an operational mode that directs illumination from said illumination subsystem into a field-of-view that includes a cutting edge of said nail clipper; wherein said handle includes an illumination boom supporting a light source; wherein said illumination boom rotates into said operational mode; and wherein said light source is activated within about five degrees of an end of a range of rotation for said illumination boom.

* * * * *